US005607145A

United States Patent [19]

Lovell

[11] Patent Number: 5,607,145

[45] Date of Patent: Mar. 4, 1997

[54] METHOD FOR PRINTING BOOKS OF BINGO PAPER

[76] Inventor: John G. Lovell, 127 H of Aker, Sevier, Tenn. 37764

[21] Appl. No.: 346,527

[22] Filed: Nov. 29, 1994

[51] Int. Cl.[6] ..... B41F 13/54

[52] U.S. Cl. ..... 270/1.01; 270/52.09; 270/58.08; 101/72; 101/227; 101/490

[58] Field of Search ..... 101/72, 76, 93.13, 101/84, 219, 226, 227, 490; 270/1.1, 52.09, 58.08

[56] References Cited

U.S. PATENT DOCUMENTS

| | | | |
|---|---|---|---|
| Re. 34,368 | 9/1993 | Frain | 270/1.1 X |
| 3,822,876 | 7/1974 | Frain | 270/1.1 |
| 3,998,446 | 12/1976 | Dent | 270/18 |
| 4,181,078 | 1/1980 | Davis | 101/132 |
| 4,270,774 | 6/1981 | Barnes | 283/62 |
| 4,444,103 | 4/1984 | Cronin | 101/93.13 |
| 4,448,127 | 5/1984 | Frain | 270/1.1 X |
| 4,830,380 | 5/1989 | Six | 101/426 X |
| 4,882,688 | 11/1989 | Kondziolka et al. | 364/519 |
| 4,885,700 | 12/1989 | Kondziolka et al. | 364/519 |
| 5,489,091 | 2/1996 | Greer et al. | 270/1.1 |

*Primary Examiner*—John E. Ryznic
*Attorney, Agent, or Firm*—Pitts & Brittian, P.C.

[57] ABSTRACT

A method for printing at least one book of bingo paper. Consecutive sheets in a book of bingo paper are printed in the same color. Each sheet is designated by a unique page number and, by utilizing a jogging plate, each page in the book is printed on a discrete plate.

5 Claims, 3 Drawing Sheets

CUTTER
LASER PRINTER
65
60
25
15
247
248
249
250
251
1
2
3
4
5
6
7
8
40
50
55
35
30
70

METHOD FOR PRINTING BOOKS OF BINGO PAPER

TECHNICAL FIELD

This invention relates to the field of bingo. More particularly, it relates to a improved process for printing books of bingo paper.

BACKGROUND ART

Bingo is a popular game of chance. A game of bingo, in its simplest form, is played on a single bingo card. However, bingo players often play multiple games, simultaneously, on sheets having a plurality of discreet bingo cards printed thereon. In order to prevent the undesired result of having multiple players simultaneously playing the same winning card, typically, 250 sheets, each having 36 discreet cards, (arranged six-by-six), are printed at a time. This results in a permutation of 9,000 different cards.

In the prior art, bingo sheets are printed with plates on a belt. Two hundred and fifty discrete plates, each having 36 discrete cards thereon are printed consecutively resulting in a case of bingo paper having 9,000 discreet cards on a total of 250 sheets of bingo paper. Various methods are known to cut these sheets into the desired size, see e.g. U.S. Pat. No. 4,448,127, issued to John J. Frain on May 15, 1984, and U.S. Pat. No. Re. 34,368, issued to John J. Frain on Sep. 7, 1993.

Typically, numerous cases are printed, each with a different color ink. Because each sheet is printed separately, and with the intent of being available for different types of "books", (in which each page has a different color), or as single sheets, every sheet has a separate, unique serial number.

Typically, purchasers purchase bingo paper in "books", each page having a different color. For example, a purchaser may wish to purchase a ten page book. Production of a ten-page book would require manually collating ten different-color sheets from ten different cases of paper, (printed in advance), along with a separately-printed, wax-sheet back page for padding, into two-hundred and fifty individual ten-page books. This is a labor intensive procedure. Those skilled in the art will readily recognize that several million books of bingo paper are distributed to commercial Bingo halls around the country each year and that a large percentage of bingo paper is distributed in the form of books.

Accordingly, it is an object of this invention to provide a more efficient method of producing books of bingo paper without requiring manual collation of pages from preprinted, cases of paper.

It is a further object of the present invention to provide a method of producing books of bingo paper in which each sheet is the same color.

Still another object of the present invention is to provide a method of producing a book of bingo paper in which each page in a given book shares a common serial number.

Other objects and advantages over the prior art will become apparent to those skilled in the art upon reading the detailed description together with the drawings as described as follows.

DISCLOSURE OF THE INVENTION

In accordance with the various features of this invention, a method for printing at least one book of bingo paper is disclosed. Consecutive sheets in a book of bingo paper are printed in the same color, each sheet containing thirty-six discreet bingo cards. Each sheet is designated by a page number printed on each individual bingo card on a sheet. In addition to the normal complement of two-hundred-fifty discrete plates along the printing belt, an additional jogging plate is utilized so that consecutive pages in a given book will be printed with separate and discrete plates. A programmable laser-printing head is placed in the paper path, after the printing belt, and before the cutter, to place at least one page number in at least one preselected position on each sheet.

BRIEF DESCRIPTION OF THE DRAWINGS

The above mentioned features of the invention will become more clearly understood from the following detailed description of the invention read together with FIG. 1, which illustrates a schematic view of a preferred printing press arrangement for the present invention.

BEST MODE FOR CARRYING OUT THE INVENTION

Figure 1:
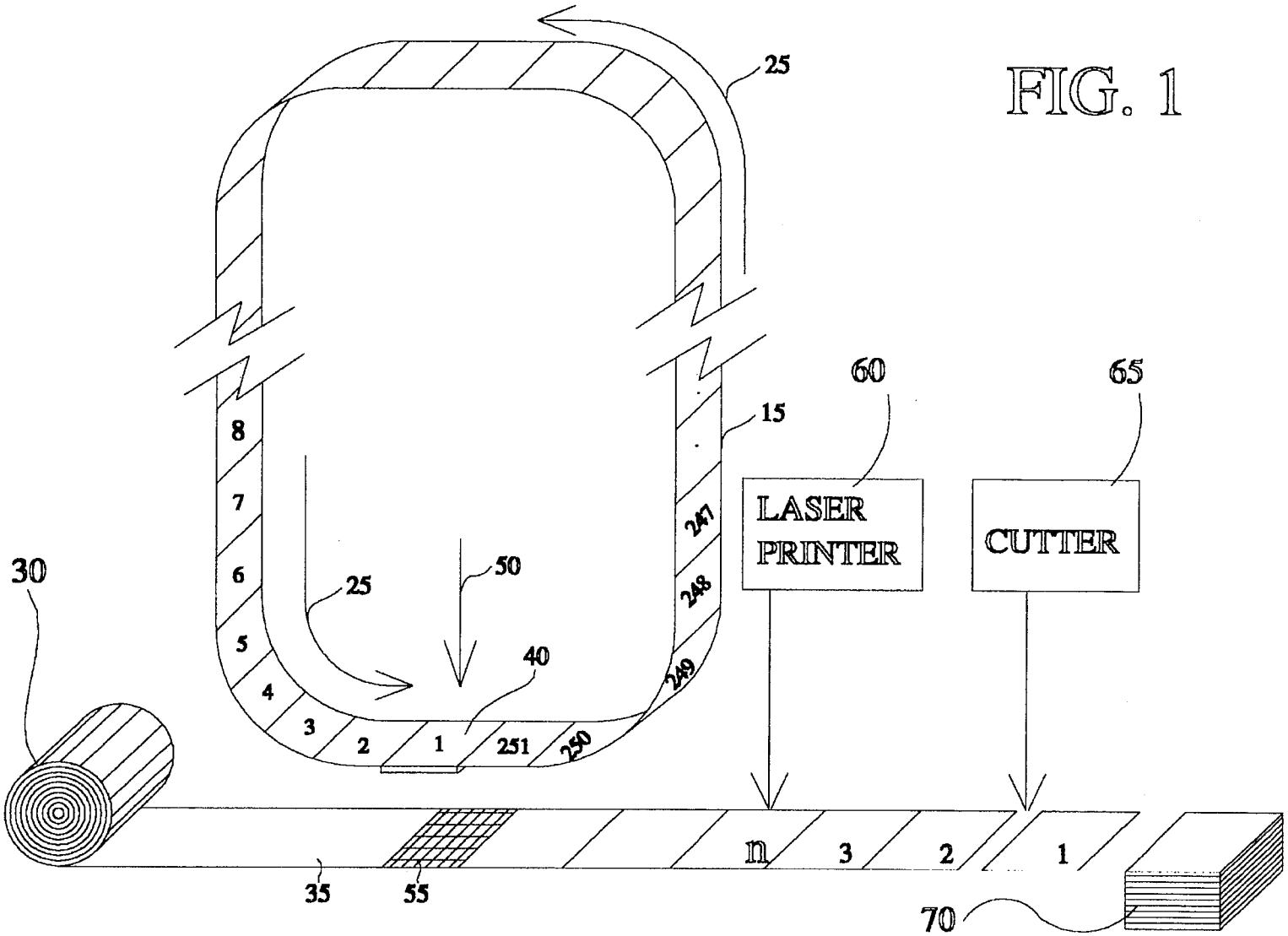
Figure 2:
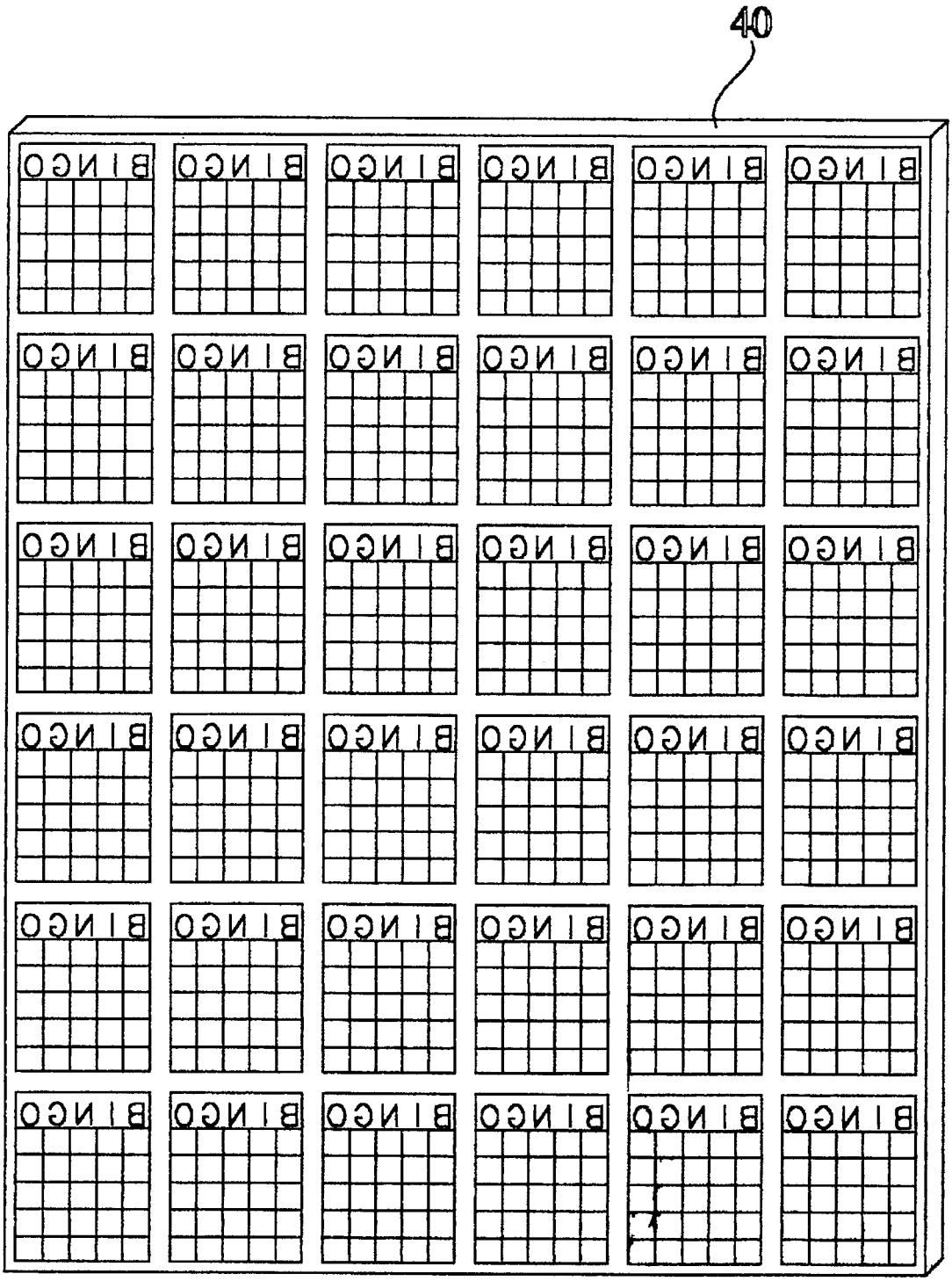
FIG. 2 illustrates a perspective view of a representative plate for printing a sheet of bingo paper having thirty-six bingo cards thereon.

Books of printed sheets of bingo paper, in which each page is the same color, are prepared by printing a selected number of discreet sheets of bingo paper, printing sequential page numbers on each sheet in descending order such that the sheets are automatically collated into books, and padding the books such that the pages are removeably secured into the books. Those skilled in the art will recognize that these sheets of bingo paper are printed with discreet plates on a printing belt 15. Printing belt 15 rotates in the direction of arrow 25. A roll 30 of paper 35 is positioned so as to align with a printing plate 40 on printing belt 15 and a press (not shown, but designated by arrow 50) engages printing plate 40 and causes printing plate 40 to imprint an image 55 on paper 35. In the preferred embodiment, at least one programmable laser printing head 60, ("PLPH"), is also placed in the paper path. PLPH 60 prints at least one discrete page number in at least one preselected position on each sheet of bingo paper that is printed. The sheets are then cut at 65 by a cutter, (not shown), and the cut sheet is collected in bin 70. In the preferred embodiment, PLPH 60 is programmed to print each sheets discrete page number in a selected location on each of the thirty-six bingo cards printed on the sheet.

Figure 3:
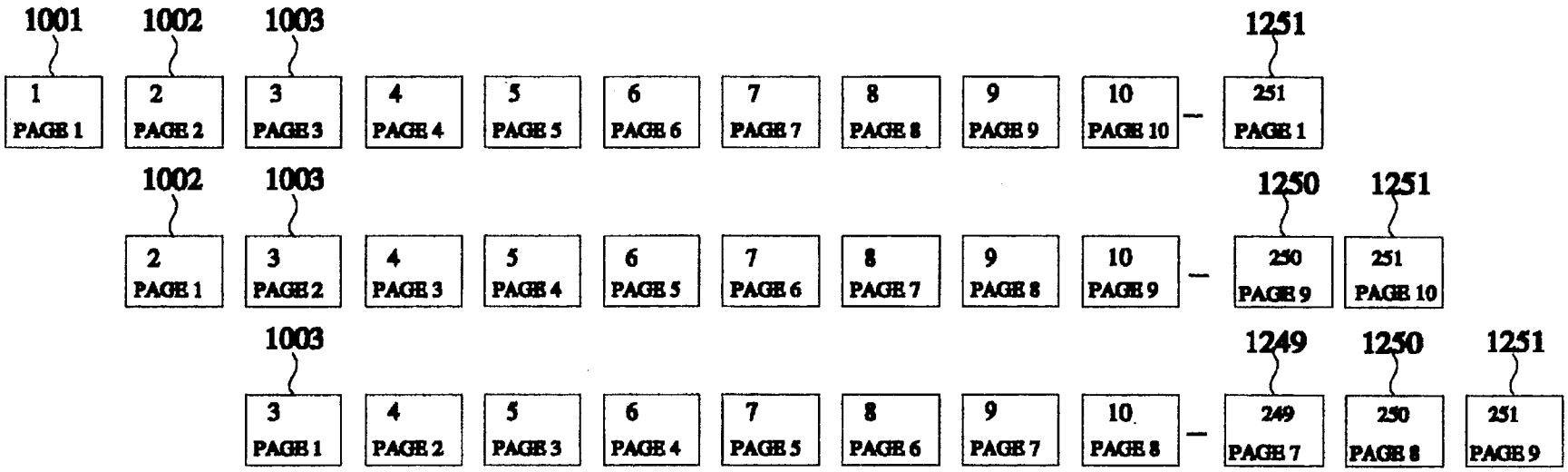
FIG. 3 illustrates a plan schematic view of the web with representative plates and the jogging plate thereon.

In order to prevent like-numbered pages of a successive books from being printed on common plates, a jogging plate is also placed on printing belt 15. In the preferred embodiment, two-hundred-fifty plates 1001, 1002, 1003, 1249, and 1250, respectively, shown in FIG. 3 are utilized, along with an additional plate 1251, shown in FIG. 3, called a "jogging" plate, which is the two-hundred-fifty-first plate. Those skilled in the art will recognize that the addition of the jogging plate increases the permutation from 9,000 to 9,036 different cards.

In the preferred embodiment, PLPH 60 is programmed to begin printing with a predesignated, last page number. PLPH 60 then numbers each sheet sequentially and in descending order. Upon reaching printed page number "1", PLPH 60 recycles to the predesignated last page number. Thus, the page numbers are printed in sequence and then repeated, again, in that sequence. However, it will be recognized that PLPH 60 could be programmed to begin with page number "1" and, increment sequentially, by 1, to a selected last page number.

For example, in order to print up to two-hundred-fifty-one distinct volumes of a ten page book of bingo paper, two-hundred-fifty plates 40 and the two-hundred-fifty-first plate 1251 or jogging plate are positioned on printing belt 15, such that the jogging plate is positioned so as to be the first plate that prints. Those skilled in the art will recognize that it is customary for plates 40 to be placed on printing belt 15 in reverse order. PLPH 60 is positioned in the paper path to print page numbers on the printed sheet and is programmed to initialize with page number "10". PLPH 60 then prints the next page number in descending order, e.g. "9", "8", "7", . . . "1". As stated above, this sequence is repeated. Thus, each page in the book is printed on different plates. Table 1 illustrates the relationship between plate number and page number.

TABLE 1

| | PAGE NUMBER | | | | | | | | | |
|---|---|---|---|---|---|---|---|---|---|---|
| Plate | 1st Run | 2nd Run | 3rd Run | 4th Run | 5th Run | 6th Run | 7th Run | 8th Run | 9th Run | 10th Run |
| 251 | 10α | 9² | 8 | 7 | 6 | 5 | 4 | 3 | 2 | 1 |
| 250 | 9α | 8² | 7 | 6 | 5 | 4 | 3 | 2 | 1 | 10 |
| 249 | 8α | 7² | 6 | 5 | 4 | 3 | 2 | 1 | 10 | 9 |
| 248 | 7α | 6α | 5 | 4 | 3 | 2 | 1 | 10 | 9 | 8 |
| 247 | 6α | 5² | 4 | 3 | 2 | 1 | 10 | 9 | 8 | 7 |
| 246 | 5α | 4² | 3 | 2 | 1 | 10 | 9 | 8 | 7 | 6 |
| 245 | 4α | 3² | 2 | 1 | 10 | 9 | 8 | 7 | 6 | 5 |
| 244 | 3α | 2² | 1 | 10 | 9 | 8 | 7 | 6 | 5 | 4 |
| 243 | 2α | 1² | 10 | 9 | 8 | 7 | 6 | 5 | 4 | 3 |
| 242 | 1α | 10 | 9 | 8 | 7 | 6 | 5 | 4 | 3 | 2 |
| 241 | 10 | 9 | 8 | 7 | 6 | 5 | 4 | 3 | 2 | 1 |
| . . . | . . . | . . . | . . . | . . . | . . . | . . . | . . . | . . . | . . . | . . . |
| 10 | 9 | 8 | 7 | 6 | 5 | 4 | 3 | 2 | 1 | 10Ω |
| 9 | 8 | 7 | 6 | 5 | 4 | 3 | 2 | 1 | 10 | 9Ω |
| 8 | 7 | 6 | 5 | 4 | 3 | 2 | 1 | 10 | 9 | 8Ω |
| 7 | 6 | 5 | 4 | 3 | 2 | 1 | 10 | 9 | 8 | 7Ω |
| 6 | 5 | 4 | 3 | 2 | 1 | 10 | 9 | 8 | 7 | 6Ω |
| 5 | 4 | 3 | 2 | 1 | 10 | 9 | 8 | 7 | 6 | 5Ω |
| 4 | 3 | 2 | 1 | 10 | 9 | 8 | 7 | 6 | 5 | 4Ω |
| 3 | 2 | 1 | 10 | 9 | 8 | 7 | 6 | 5 | 4 | 3Ω |
| 2 | 1 | 10 | 9 | 8 | 7 | 6 | 5 | 4 | 3 | 2Ω |
| 1 | 10 | 9 | 8 | 7 | 6 | 5 | 4 | 3 | 2 | 1Ω |

α = 1st ten-page book printed
† = 26th ten-page book printed
Ω = 251st ten-page book printed As can be seen, each page of the first book printed, designated "α" in Table 1, is printed on a separate plate. Likewise, each page of the last book printed, designated "Ω" in Table 1, is printed on a different plate. The result is that each page of the ten page book is printed on a different plate. Further, each of the 251 volumes printed in this manner will have like page numbers printed with different plates. This result is set out below in Table 2.

TABLE 2

| | 1st Book Printed | 26th Book Printed | . . . | 251st Book Printed |
|---|---|---|---|---|
| Page 1 | P #242 | P #243 | . . . | P #1 |
| Page 2 | P #243 | p #244 | . . . | P #2 |
| Page 3 | P #244 | P #245 | . . . | P #3 |
| Page 4 | P #245 | P #246 | . . . | P #4 |
| Page 5 | P #246 | P #247 | . . . | P #5 |
| Page 6 | P #247 | P #248 | . . . | P #6 |
| Page 7 | P #248 | P #249 | . . . | P #7 |
| Page 8 | P #249 | P #250 | . . . | P #8 |
| Page 9 | P #250 | P #251 | . . . | P #9 |
| Page 10 | P #251 | P #1 | . . . | P #10 |

Thus, it can be seen that as the numbered sheets are cut at 65 and fall into bin 70, they are automatically collated into books of pages 1–10. These collated books are then padded and are ready to be cut to size, or delivered as is. As a result, the labor of collating multiple colored pages into books is eliminated. Also, by having separate, discrete and individually numbered pages, all of the books from a printing cycle can be printed in the same color as opposed to the present method of having books that contain multiple, individually-colored, discrete sheets.

Having books of bingo paper in which all of the pages of a given book are the same color offers advantages to the commercial bingo hall operator, ("BHO"). First, it will allow the bingo hall to have multi-level books of bingo paper. In other words, books that sell at different amounts of money. In this regard, the BHO can offer a $100 level book, $200 level book, and a $300 level book, which will be referred to as levels 1, 2 and 3. The BHO could sell Level 1 for $10.00, Level 2 at $15.00 and Level 3 at $20.00 a book. The BHO can designate Level 1 as red books, Level 2 as blue books, Level 3 as orange books, etc. This provides readily identifiable, by the BHO and the player, levels of play.

Further, the present method allows for greater choice of product, inasmuch as it increases the number of pages that can be bound as a single book. The prior art method is limited to the number of readily recognizable colors as the maximum number of pages. By having discreetly numbered pages of a single color, there is no logical limit to the number of pages in a given book.

An additional advantage for the BHO in books produced in accordance with the present invention is the option of multiple levels of play designated by color, including very high stakes levels of play. It will be readily recognized by those skilled in the art that high-stakes players prefer readily recognizable visual cues that other players recognize as high stakes levels. For the high stakes player, the upper level books, then, become a status symbol, which is important in the type of atmosphere often found in the commercial bingo hall.

Still yet another advantage offered over the prior art method which produces different colored sheets, (each of which has a distinct serial number), is that books printed in accordance with the method of the present invention can have the same serial number for each page in a book.

From the foregoing description, it will be recognized by those skilled in the art that an improved method of printing books of bingo paper offering advantages over the prior art has been provided. Specifically, the improved method of printing books of bingo paper provides a more efficient method of producing books of bingo paper without requiring manual collation of pages. By providing individual discrete pages with page numbers, books of bingo paper in which each sheet is the same color, thus offering advantages to the end user, is also provided. Similarly, the present invention provides a method of producing a book of bingo paper in which each page in a given book shares a common serial number.

While a preferred embodiment has been shown and described, it will be understood that it is not intended to limit the disclosure, but rather it is intended to cover all modifications and alternate methods falling within the spirit and the scope of the invention as defined in the appended claims and their equivalents.

Having thus described the aforementioned invention, I claim:

1. A method for preparing books of bingo paper containing common-colored sheets, each said book having more than four pages, said method comprising, the steps:

printing like-colored sheets of bingo paper with a selected number of discrete printing plates and a discrete jogging plate, wherein said jogging plate is an additional discrete printing plate, wherein said selected number of discrete printing plates and said discrete jogging printing plate are on a single printing web defining a single paper path;

printing at least one page number on each like-colored printed sheet, with a programmable printer for printing sequential page numbers, said programmable printer being in said single paper path, whereby successive sheets are printed; and padding said successive page-numbered sheets into books, said books having more than four pages, such that said sheets are removably secured in said books.

2. The method of claim 1 wherein said selected number of discrete plates is two-hundred-fifty plates and said jogging plate is a two-hundred-fifty-first plate.

3. The method of claim 1 wherein said plates contain thirty-six discrete bingo cards.

4. The method of claim 1 wherein in said step of printing at least one page number on each printed sheet, said programmable printer is programmed to begin printing with a selected page number, wherein said selected page number is higher than the number four, and to sequentially number successive sheets in descending order and to print said selected page number on at least one preselected location on each printed sheet.

5. A method for preparing books of bingo paper containing common-colored sheets, each said book having more than four pages, said method comprising, the steps:

printing like-colored sheets of bingo paper with two-hundred-fifty discrete printing plates and a discrete jogging plate, wherein said discrete jogging plate is an additional discrete printing plate and defines the two-hundred-fifty-first discrete printing plate, wherein said two-hundred-fifty discrete printing plates and said discrete jogging printing plate each contain thirty-six discrete bingo cards and further wherein said two-hundred-fifty discrete printing plates and said discrete jogging printing plate are on a single printing web defining a single paper path;

printing at least one page number on each like-colored printed sheet, with a programmable laser printing head for printing sequential page numbers, said programmable laser printing head being in said single paper path, wherein said programmable laser printing head is programmed to print a selected page number on at least one preselected location on each printed sheet, wherein said selected page number is higher than the number four, said programmable laser printing head being further programmed to sequentially number successive sheets in descending order and to reset to said designated number after printing a selected page number, whereby successive sheets are printed; and padding said successively numbered, like-colored sheets into books, said books having more than four pages, such that said sheets are removably secured in said books.

* * * * *

UNITED STATES PATENT AND TRADEMARK OFFICE

CERTIFICATE OF CORRECTION

PATENT NO. : 5,607,145

DATED : March 4, 1997

INVENTOR(S) : John G. Lovell

It is certified that error appears in the above-identified patent and that said Letters Patent is hereby corrected as shown below:

On the title page, Item [73], Assignee is:

Stuat Enterainment, Inc.
Council Bluff, Iowa

Signed and Sealed this

Twenty-fourth Day of February, 1998

*Attest:*

Bruce Lehman

BRUCE LEHMAN

*Attesting Officer*

*Commissioner of Patents and Trademarks*